US007774990B1

(12) United States Patent
Castellanos

(10) Patent No.: US 7,774,990 B1
(45) Date of Patent: Aug. 17, 2010

(54) ROOF HIP AND RIDGE ANCHOR DEVICE (CIP)

(76) Inventor: Tom Castellanos, 2301 W. 8th La., Hialeah, FL (US) 33010

( * ) Notice: Subject to any disclaimer, the term of this patent is extended or adjusted under 35 U.S.C. 154(b) by 0 days.

(21) Appl. No.: 12/558,679

(22) Filed: Sep. 14, 2009

Related U.S. Application Data

(63) Continuation-in-part of application No. 11/614,190, filed on Dec. 21, 2006.

(51) Int. Cl.
*E04B 7/00* (2006.01)

(52) U.S. Cl. ..... 52/57; 52/43; 52/198; 52/199; 52/302.1

(58) Field of Classification Search ..... 52/41, 52/42, 43, 44, 87, 90.1, 198, 199, 302.1, 52/302.3, 465
See application file for complete search history.

(56) References Cited

U.S. PATENT DOCUMENTS

| | | | | |
|---|---|---|---|---|
| 1,093,201 | A * | 4/1914 | Owen | 52/42 |
| 1,336,945 | A * | 4/1920 | Dickelman | 454/175 |
| 4,011,704 | A * | 3/1977 | O'Konski | 52/481.1 |
| 4,545,292 | A * | 10/1985 | Inokawa et al. | 454/365 |
| 4,677,800 | A * | 7/1987 | Roodvoets | 52/309.12 |
| 5,331,783 | A * | 7/1994 | Kasner et al. | 52/199 |
| 5,390,453 | A * | 2/1995 | Untiedt | 52/90.1 |
| 5,419,941 | A * | 5/1995 | Noone et al. | 428/141 |
| 5,752,353 | A * | 5/1998 | Koenig et al. | 52/255 |
| 5,904,016 | A * | 5/1999 | Koenig et al. | 52/255 |
| 6,061,973 | A * | 5/2000 | Accardi et al. | 52/90.1 |
| RE37,388 | E * | 9/2001 | Kasner et al. | 52/57 |
| 6,381,916 | B1 * | 5/2002 | Maisch et al. | 52/846 |
| 6,647,675 | B1 * | 11/2003 | Castellanos | 52/198 |
| 6,684,581 | B2 * | 2/2004 | Robinson et al. | 52/198 |
| 7,137,224 | B2 * | 11/2006 | Rasmussen et al. | 52/96 |
| 7,562,498 | B2 * | 7/2009 | Galeazzo et al. | 52/198 |
| 2002/0100232 | A1 * | 8/2002 | Robinson et al. | 52/198 |
| 2005/0116504 | A1 * | 6/2005 | Yurgevich et al. | 296/186.1 |
| 2007/0094948 | A1 * | 5/2007 | Osborne et al. | 52/90.1 |

(Continued)

FOREIGN PATENT DOCUMENTS

| | | | |
|---|---|---|---|
| EP | 320343 | A1 * | 6/1989 |

(Continued)

*Primary Examiner*—Brian E Glessner
*Assistant Examiner*—Patrick Maestri
(74) *Attorney, Agent, or Firm*—Sanchelima & Assoc., P.A.

(57) ABSTRACT

A device for roof structures having a ridge or hip defined by the planes of two roof decks, disposed at an angle with respect to each other defining a longitudinal joint. A longitudinally extending cover with at least one coextensive channel defined by a bottom, two spacer walls and two lateral walls are mounted over the ridge or hip. The channel(s) increases the effective contact area to enhance the gripping action of the adhesive compound. From the longitudinal bends of the cover wall extend two perpendicularly extending walls with distal ends that continue with longitudinally coextensive flanges. The longitudinal flanges extend at an angle to be cooperatively and rigidly mounted over the roof decks with mechanical fasteners. An adhesive compound is positioned in the channel and over the cover. The adhesive is pressed so that part of it passes through and is lodged within the connected depressed slots positioned along the bottom, spacer and/or lateral walls that define the channel thereby creating a mechanical anchorage with the device. Tile accessories are placed over the cover and in contact with the adhesive compound to secure them to the device.

5 Claims, 5 Drawing Sheets

U.S. PATENT DOCUMENTS

| | | | | |
|---|---|---|---|---|
| 2007/0107333 | A1* | 5/2007 | Marsh et al. | 52/223.7 |
| 2008/0092480 | A1* | 4/2008 | Stanley | 52/716.8 |
| 2008/0216442 | A1* | 9/2008 | Shubin | 52/741.4 |
| 2008/0318516 | A1* | 12/2008 | Rotter | 454/365 |

FOREIGN PATENT DOCUMENTS

| | | | |
|---|---|---|---|
| JP | 61037424 | A * | 2/1986 |

* cited by examiner

ROOF HIP AND RIDGE ANCHOR DEVICE (CIP)

OTHER RELATED APPLICATIONS

The present application is a continuation-in-part of pending U.S. patent application Ser. No. 11/614,190, filed on Dec. 21, 2006, which is hereby incorporated by reference.

BACKGROUND OF THE INVENTION

1. Field of the Invention

The present invention relates to roof hip and ridge anchor device, and more particularly, to such a device that is used in conjunction with an adhesive compound to secure the tiles to the device which in turn is mechanically anchored to the roof structure.

2. Description of the Related Art

Several designs for roof hip and ridge anchor devices have been designed in the past. None of them, however, include the anchorage features of the present invention while simultaneously keeping the design compatible with roll forming manufacturing processes. Roll forming techniques are suitable for relatively inexpensive production operations but carry inherent limitations. The present invention reconciles these limitations with a sturdy design that results in an article of manufacture that can withstand the most exigent wind pressures to which a roof envelope is exposed.

Applicant believes that the closest reference corresponds to U.S. Pat. No. 6,647,675 issued to the inventor herein on Nov. 18, 2003. However, it differs from the present invention because it fails to provide an elongated cover with at least one elongated channel with a coextensive bottom wall and two longitudinally extending walls. Additionally, the mechanical anchorage between the adhesive compound and the device results in a device with wind pressure advantages. There have not been any accessory devices in the dwelling roof industry, prior to Applicant's invention, that used an elongated channel to increase the contact area of an adhesive. The closest art known to Applicant that provides for a structure that includes a channel or depression is U.S. Pat. No. 1,093,201 issued to Owen. However, there is no suggestion in the reference to maximizing the contact area for receiving an adhesive. The channel in Owen's patent is used to provide a barrier for water to be forced up and not the maximization of contact area for an adhesive. In the present invention, the bottom wall(s) of the channel (or channels) includes depressed slots bridge notches that form a bridge with a through passage that permit the adhesive compound to be forced through. Some of the adhesive compound is lodged adjacent to the bridge. Thus, when set, the adhesive compound provides an anchorage mechanism that resists substantially greater pulling forces than were previously withstood with dimples or through holes. This particular type of opening has provided superior results in pulling tests and it is simultaneously compatible with cost efficient roll forming techniques.

Additionally, the present invention is an improvement over the parent application by providing a connected depressed portion with a through passage for receiving therethrough the adhesive.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a roof hip and ridge attachment device that is compatible with roll forming manufacturing processes while simultaneously providing the mechanical anchorage features to withstand wind forces to which roofs may be exposed.

It is another object of this invention to provide a device that maximizes the contact area with the adhesive compound with longitudinally extending channels and cooperatively positioned through openings that permit the adhesive compound to go through.

Another object of the invention is to provide a structure that will cooperate with the adhesive to enhance the engagement of the former with the tile.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
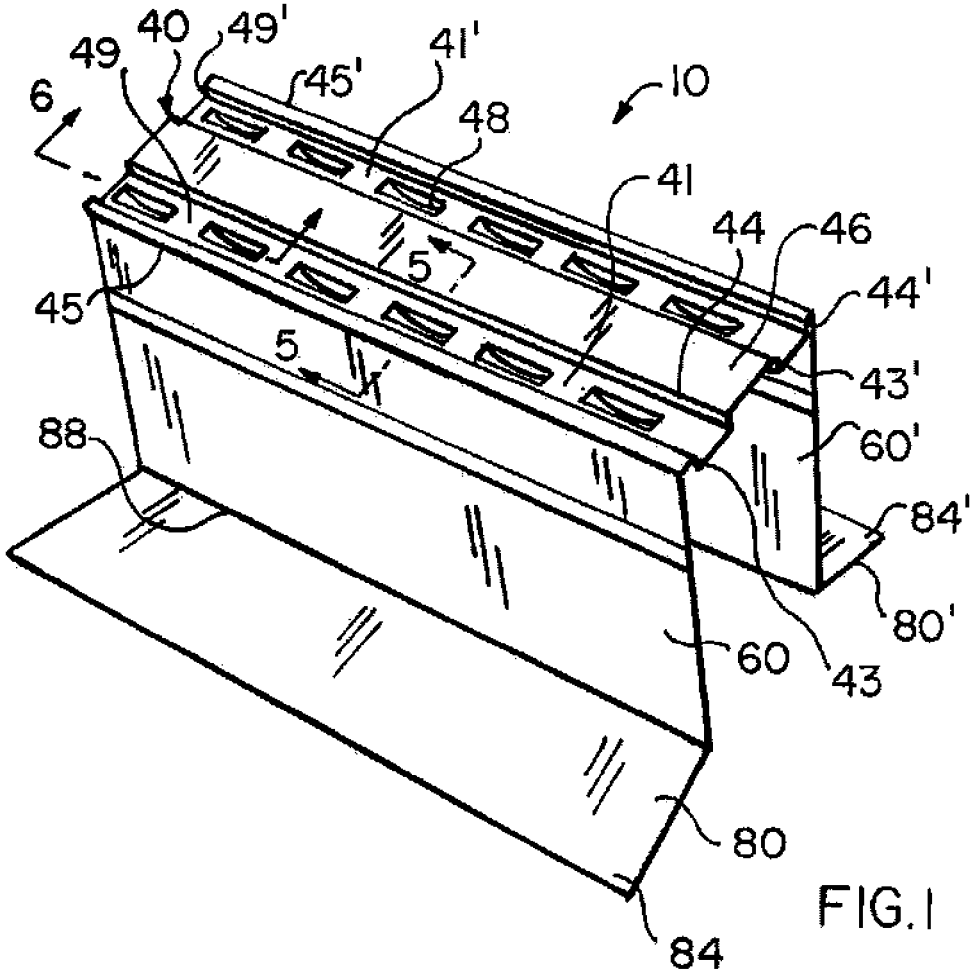
FIG. 1 represents an inclined side isometric view of an embodiment of the accessory subject of the present invention.

Referring now to the drawings, where the present invention is generally referred to with numeral 10, it can be observed that it basically includes an elongated cover 40, with longitudinal bends 45 and 45' from where coextensive elongated spaced apart walls 60 and 60' extend ending with longitudinally extending flange members 80 and 80' at an angle that start from longitudinal bends 88 and 88' that in turn terminate with flange folds 84 and 84' defining flanges' distal folded ends 82 and 82'. The angle of flange members 80 and 80' with respect to walls 60 and 60' varies depending on the pitch of the roof structure to which the former are mounted.

Figure 2:
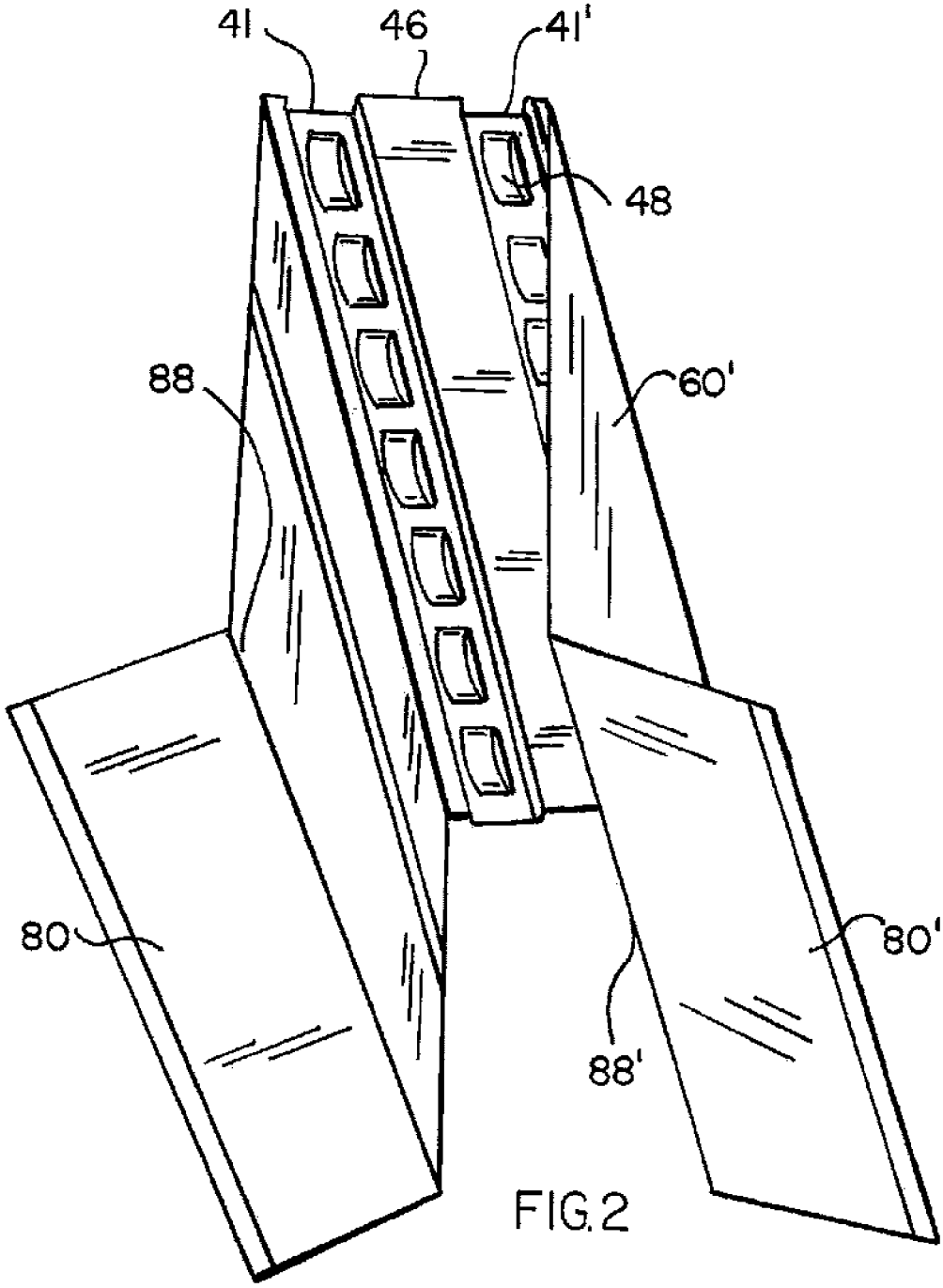
FIG. 2 shows an inclined bottom isometric view of the embodiment shown in the previous figures.
Figure 3:
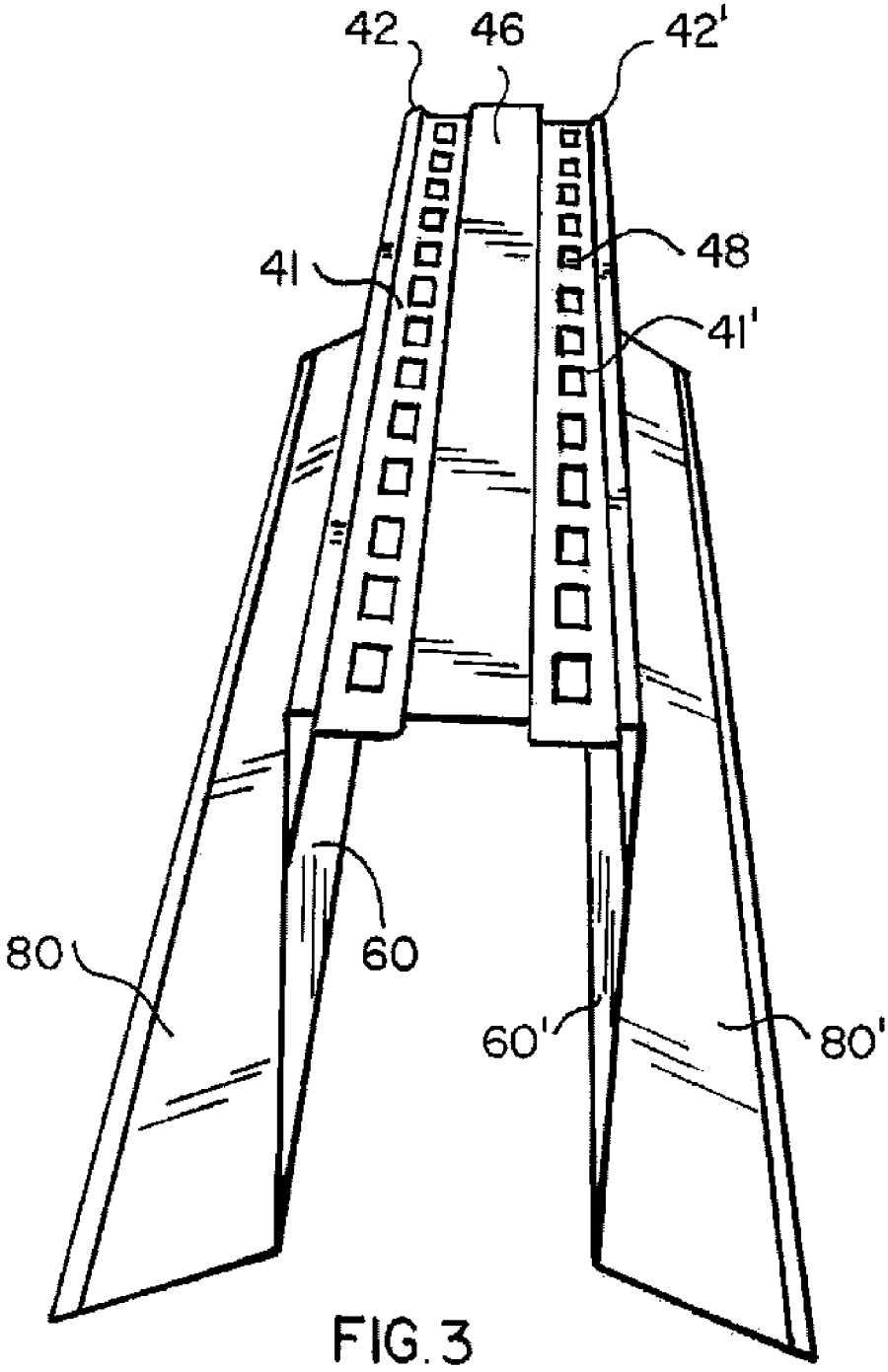
FIG. 3 illustrates an inclined top isometric view of the embodiment shown in the previous two figures.

Cover 40, in one of the embodiments, as shown in FIGS. 1, 2 and 3, includes two coextensive channels 41 and 41' defined by lateral walls 43; 44; and 43'; 44', respectively, separated by coextensive bottom walls 49 and 49'. Channels 41 and 41' are separated from each other by longitudinal central spacer wall 46 and to the longitudinal edges 45 and 45' by longitudinal spacer walls 42 and 42', in this embodiment.

Figure 4:
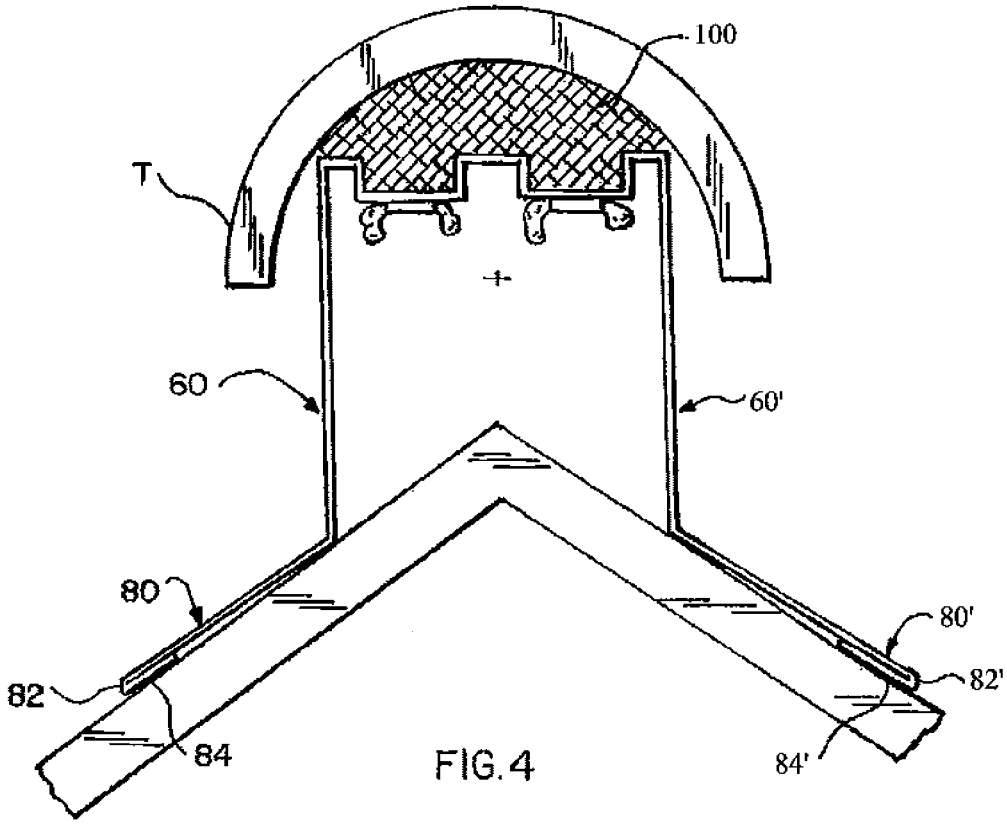
FIG. 4 is a side elevational representation of the embodiment shown in the previous figures mounted to a roof hip with adhesive flowing through the notches.
Figure 5:
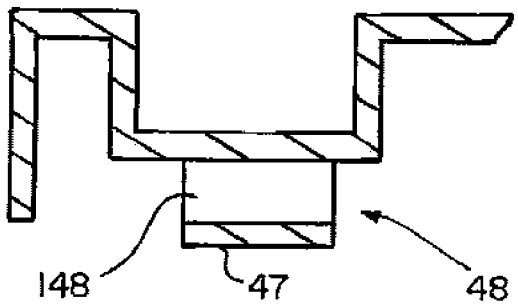
FIG. 5 is an enlarged side cross-sectional detail view taken along cutting line 5 in FIG. 1 of cover 40 where a notch is located.
Figure 6:
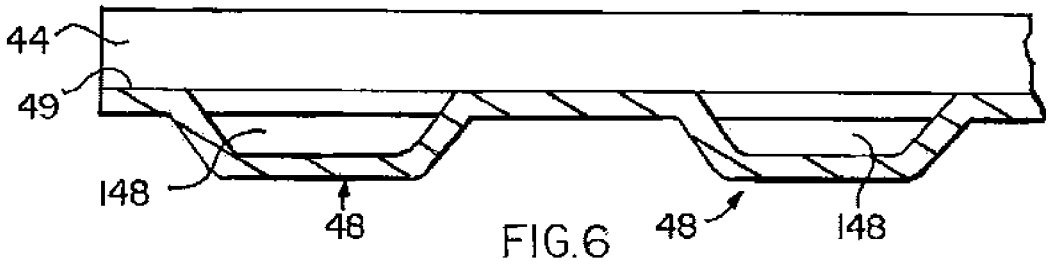
FIG. 6 is an enlarged side cross-sectional detail view taken along cutting line 6 in FIG. 1 of a portion of cover 40 where the notches are located.

As seen in FIG. 4, adhesive compound 100 is placed on cover 40 covering it substantially, including channels 41 and 41'. Bridge notches 48 are formed on bottom walls 49 and 49'. Notches 48 extend longitudinally a predetermined distance and include a bridge 47 that is separated and kept at parallel and spaced apart relationship with respect to the planes of bottom walls 49 and 49'. Notches 48 can be formed by punching bottom walls 49; 49' with roll-forming compatible methods.

When tile T is mounted above adhesive 100, as show in FIG. 4, pressure of a predetermined magnitude is applied, forcing adhesive 100 to go through notch opening 148. When adhesive 100 oozes through opening 148 and hardens, an effective anchorage engagement results. The resulting anchorage engagement relies on the shear strength of the set (hardened) adhesive compound and not merely its ability to stick to a surface. The width of bridge notches 48, as well as the degree of the depression of bridge 47, defines the dimensions of notch opening 148 to lodge an effective amount of adhesive 100.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for roof structures having a ridge or hip defined by the planes of two roof decks, disposed at an angle with respect to each other and defining a longitudinal joint, comprising:

A) an elongated cover wall having at least one elongated channel, each of said at least one elongated channel defined by a coextensive longitudinally extending bottom wall, two coextensive longitudinally extending lateral walls, and two coextensive longitudinally extending spacer walls, and said elongated cover wall including first and second longitudinal bends and said bottom wall of said at least one channel including a first plurality of connected bridge notches defining a through passage and a bridge adjacent thereto and said cover being mounted over ridge or hip;

B) first and second elongated walls extending, respectively, from said first and second longitudinal bends substantially perpendicularly to the plane of said cover, and said first and second elongated walls being kept at a substantially parallel and spaced apart relationship with respect to each other, each of said first and second elongated walls including a coextensive longitudinal flange with respective longitudinal ends, said flanges extending at a predetermined angle with respect to said first and second elongated walls that cooperate with the decks of a roof that form a ridge or hip, said flanges being rigidly mounted to said decks;

C) adhesive compound means positioned within said elongated channel through said through passage to provide a rigid anchorage when said adhesive compound means hardens and said adhesive compound means being also applied over said cover to support a tile thereon.

2. The device set forth in claim 1 wherein said elongated cover has two elongated channels.

3. The device set forth in claim 2 wherein said longitudinal ends of said flanges terminate with end folds.

4. The device set forth in claim 1 wherein said bridge slots are sufficiently wide to permit an effective amount of said adhesive compound means to be lodged adjacent to said bridge.

5. The device set forth in claim 4 wherein said longitudinal ends of said flanges terminate with end folds.

* * * * *